United States Patent [19]

Hayward

[11] Patent Number: 4,466,329

[45] Date of Patent: Aug. 21, 1984

[54] HANDBELL

[75] Inventor: Gamon B. Hayward, Escondido, Calif.

[73] Assignee: Maas-Rowe Carillons, Inc., Escondido, Calif.

[21] Appl. No.: 367,377

[22] Filed: Apr. 12, 1982

[51] Int. Cl.[3] ..... G10D 13/08; G10K 1/00; G10K 3/00

[52] U.S. Cl. ..... 84/406

[58] Field of Search ..... 84/406, 407; 340/395; 116/148, 150, 170

[56] References Cited

U.S. PATENT DOCUMENTS 406,294 7/1889 McLaughlin ..... 340/395
870,025 11/1907 Elsas ..... 84/406

*Primary Examiner*—L. T. Hix
*Assistant Examiner*—Douglas S. Lee
*Attorney, Agent, or Firm*—Flam&Flam

[57] ABSTRACT

A handbell utilizes magnetic repulsion for impact control.

11 Claims, 7 Drawing Figures

HANDBELL

BACKGROUND OF THE INVENTION

1. Field of Invention

This invention relates to handbells of the type commonly used by a group of performers. Handbells are provided in one or more sets each spanning a musical range. Individuals of the group are responsible for assigned numbers of bells. Together, the individuals, under the direction of a conductor, perform a musical bell composition. The present invention is concerned with the clapper mechanism whereby a clean bell sound is created free of unwanted rattles or other noises.

2. Discussion of Prior Art—Summary of Invention

It has long been realized that, in order to create a clean bell tone, the clapper must impact but once. To prevent the undesired reiterative effect, spring restraining devices of various types have been used, ranging from resilient bands to leaf springs. Yielding restraint is imposed upon the clapper bar before the clapper impacts. The increasing spring force effectively moves the clapper away from the bell after impact, and the spring mechanism is just strong enough to prevent an unintended impact repeat.

Such spring mechansims often lose adjustment, and furthermore, are difficult to readjust. Not infrequently the mechanisms generate their own annoying noises.

The primary object of the present invention is to provide a simple reliable noiseless yielding restraint for a bell clapper. For this purpose, I provide a clapper bar that is restrained by a simple arrangement of two permanent magnets, individually and easily adjustable.

BRIEF DESCRIPTION OF THE DRAWINGS

A detailed description of the invention will be made with reference to the accompanying drawings wherein like numerals designate corresponding parts in the several figures. These drawings are to scale.

DETAILED DESCRIPTION OF THE PREFERRED EMBODIMENT

The following detailed description is of the best presently contemplated mode of carrying out the invention. This description is not to be taken in a limiting sense, but is made merely for purposes of illustrating the general principles of the invention, since the scope of the invention is best defined by the appended claims.

Figure 1:
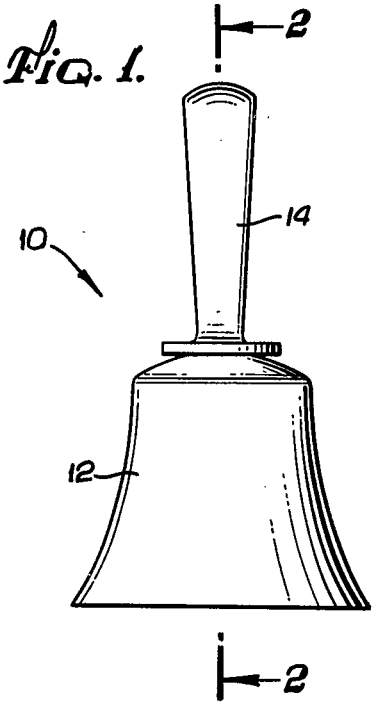
FIG. 1 is an elevational view of a handbell incorporating the present invention.

The handbell 10 (FIG. 1) comprises three essential parts, a bell 12, a one piece molded handle 14 and a clapper assembly 16.

Figure 2:
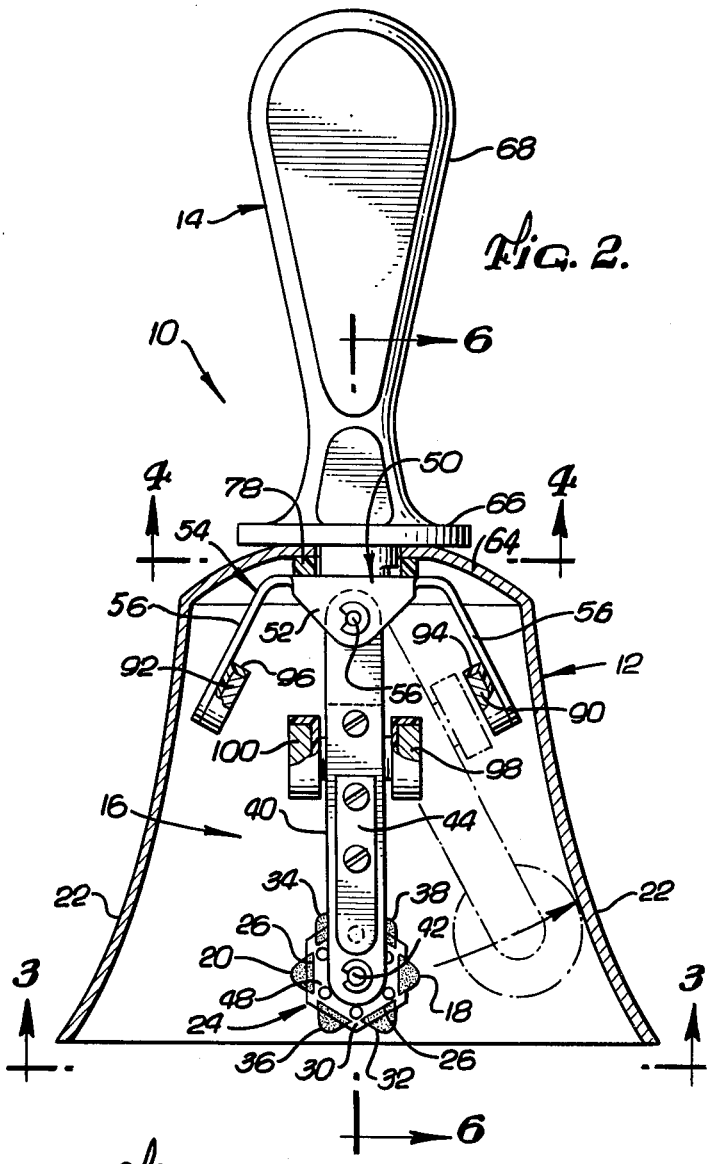
FIG. 2 is a longitudinal sectional view of the handbell, and taken along a plane corresponding to line 2—2 of FIG. 1.
Figure 4:
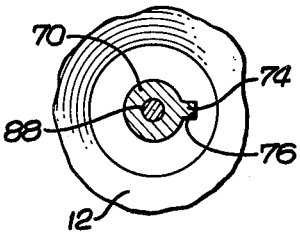
FIG. 4 is a fragmentary transverse sectional view through the handle hub and along a plane corresponding to line 4—4 of FIG. 2.
Figure 3:
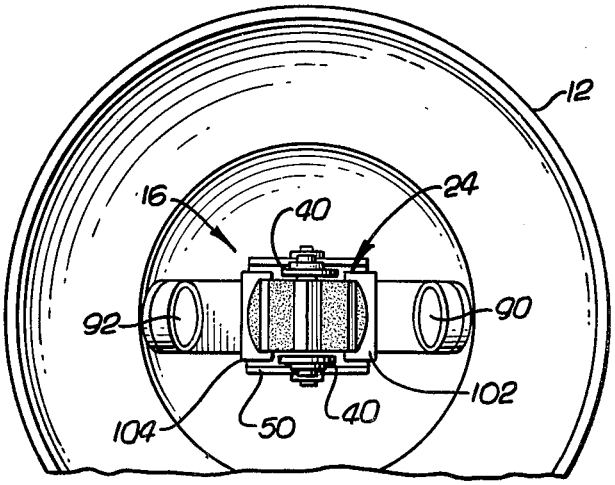
FIG. 3 is an end elevational view of the handbell.

The operative elements of the clapper assembly 16 are two bumpers 18 and 20 (FIG. 2). The bumpers are swingably supported so that one of them strikes the opposite sound bow 22 of the bell 12. The bumpers 18 and 20 are fitted to a clapper 24. The clapper 24 has the form of a wheel or block of relatively massive material such as brass. The periphery of the wheel has six (or three pairs) equiangularly located dovetail grooves 26 extending transversely between opposite face 28 and 30 of the clapper wheel 24. The bumpers 18 and 20 fit two of the grooves 26. The bumpers are easily installed or removed by sliding them into or out of the grooves 26. Other pairs of bumpers 32–34 and 36–38 having different strike characteristics fit the two other pairs of grooves 26. The mounting of the clapper wheel makes it possible for the other pairs of bumpers to be operatively positioned.

Figure 6:
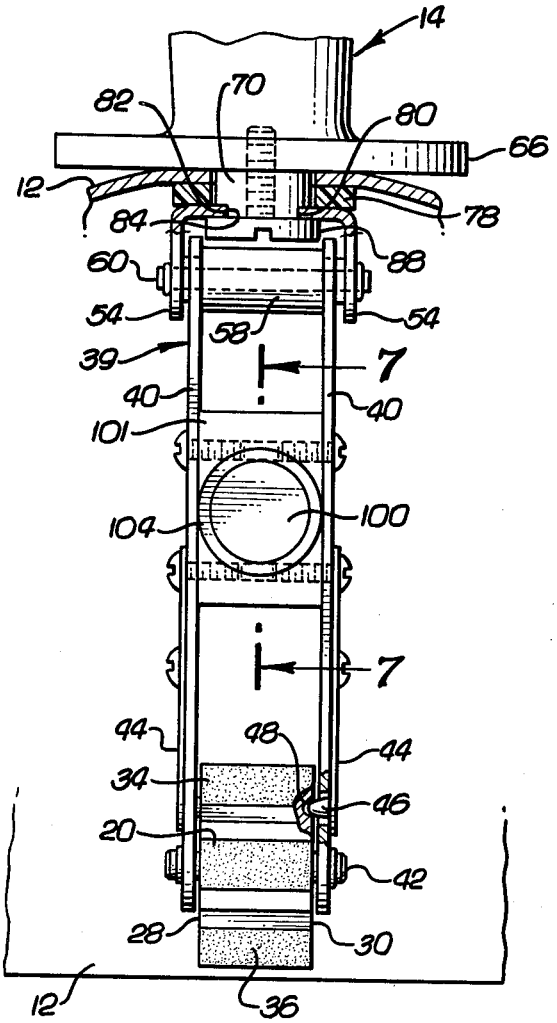
FIG. 6 is an enlarged fragmentary longitudinal sectional view similar to FIG. 2, but taken along the plane 6—6 of FIG. 2, which plane is at right angles to the plane of FIG. 2.

The clapper or wheel 24 is carried at one end of a clapper bar 39 comprising two spaced parallel elongated side plates 40. The clapper or wheel 24 fits between corresponding ends of the side plates 40 with the clapper faces 28 and 38 opposed to the inside surfaces of the respective side plates. The wheel is supported for angular adjustment by an axle of pin 42 that also serves to connect the side plates. The clapper wheel has a diameter that exceeds the width of the side plates so that operative bumpers project laterally in strike position. By angularly moving the clapper wheel 24, one of the three pairs of bumpers is operatively positioned. A leaf spring 44 carried on the outside of one of the clapper plates 40, has a detent 46 (FIG. 6) that cooperates with one of six detent recesses 48 in one side face 30 of the clapper wheel thus releasably to hold the clapper wheel in a selected position.

Figure 5:
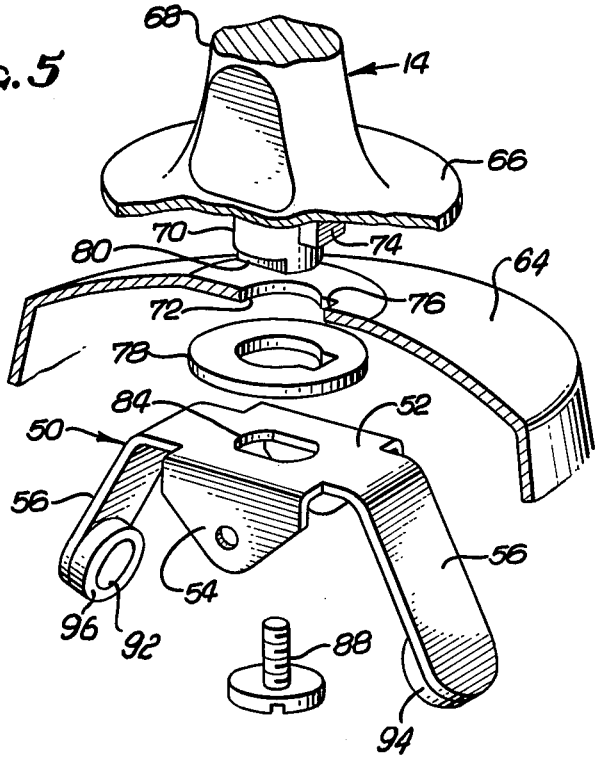
FIG. 5 is an exploded view showing the assembly of parts at the bell head.

The opposite end of the clapper bar 39 is pivotally mounted by a bracket 50 (FIG. 5). The bracket 50, which may be made as a stamping, has a base plate 52, clevis wings 54 at opposite sides and mounting arms 56 at opposite ends. A cylindrical bearing sleeve 58 (FIG. 6) is placed between the clapper plates 40 and serves to space them. An axle or pin 60 (FIGS. 2 and 6) extends through the bearing sleeve 58 and provides a stable, noise free pivot mounting.

The base plate 52 of the bracket 50 is attached to the bell head or crown region 64 by the aid of the handle 14. The handle 14 has a flange 66 from which the grip part 68 of the handle extends. The flange 66 forms a convenient rest or stop for the circled thumb and forefinger of the user. On the other side of the flange 66 is a hub 70 that projects through an aperture 72 at the crown region. The hub 70 has a lug 74 that fits a corresponding slot 76 in the bell aperture 72 so that the handle and the bell are fixed in a predetermined angular alignment.

The lug 74 corresponds to the swing plane of the clapper bar by virtue of a registry between the hub 70 and the bracket 50 presently to be described. Hence the slot 76 is located to determine the optimum bell strike region.

The handle lug 74 projects through a compressible spacer 78 (FIGS. 5 and 6) on the inside of the bell. The end of the hub 70 has flats 80 and 82 on opposite sides that fit sides of an opening 84 in the bracket base 52. A screw 88 clamps the bracket 50 and handle to the bell.

Before one of the bumpers 18 or 20 impacts, a yielding restraint is placed upon the clapper bar. For this purpose a pair of permanent magnets 90 and 92 are provided (FIGS. 2 and 5). These magnets are cylindrical. Each mounting arm 56 extends along the inside of the bell with its distal end located near the upper waist portion of the bell. At the inside of the distal end of each of the arms 56, one of the magnets 90, 92 is secured. The magnets 90 and 92 are thus located diametrically on opposite sides of the bell and substantially in the plane of movement of the clapper assembly to be addressed thereto.

Figure 7:
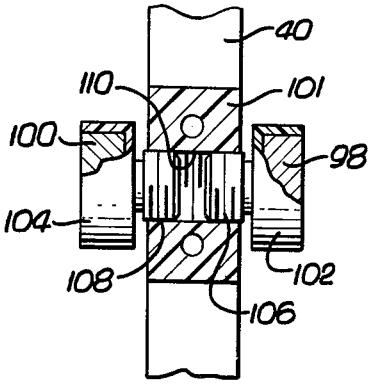
FIG. 7 is a fragmentary sectional view taken along a plane corresponding to line 7—7 of FIG. 6 and showing the magnets carried by the clapper bar.

The magnets 90 and 92 oppose a companion pair of similar magnets 98 and 100 carried by the clapper bar 39. All the magnets 98 and 100 are carried by a mounting block 101 (See also FIGS. 6 and 7) fastened between the clapper bar plates 40. The magnets 98 and 100 are secured in cups 102 and 104 respectively. The cups have threaded stems 106, 108 that cooperate respectively with opposite ends of a through threaded opening 110 of the mounting block 101. The cups 102 and 104 are made of non-magnetic plastic material such as nylon. As shown in phantom lines in FIG. 2, the magnet 98 closely approaches, but does not engage, the magnet 90 at the point of impact between the bumper 18 and the bell. The magnets 98 and 90 are arranged so that their corresponding poles are generally aligned, that is to say, North to North and South to South. A force of repulsion accordingly, is generated as the bumper 18 approaches the bell, the force increasing as the distance between the magnets decreases. An effective return force is thus provided that prevents the undesired reiterative strike. The magnetic force is also strong enough to prevent any accidental engagement of the bumper 18 while the bell is handled preparatory to play.

The required feel or strength of return force is initially adjusted by the bell manufacturer; however, the artist can readily adjust the force or feel by turning the magnets 98 and 100 part or full turns until the desired action is obtained.

The return force mechanism when in operation, has no moving parts apart from the swinging clapper bar 40 itself. The axle 60 is relatively long and closely fits the bearing sleeve 58. No squeaks, rattles or other spurious noises are generated. The mechanism is entirely silent, especially since the retarding force between the magnets occurs without mechanical contact.

Intending to claim all novel, useful and unobvious features shown or described, I claim the following:

1. In a handbell:

(a) a bell;

(b) an operating handle attached to the head of the bell;

(c) a clapper assembly including a clapper and a clapper bar confined for movement in a swing plane; and (d) companion magnetic means operable between the clapper assembly and the bell yieldingly to resist movement of the clapper into engagement with the bell and to exert a force to move the clapper from the bell after engagement, said companion magnetic means at all times being free of mechanical engagement during swinging movement of said clapper.

2. The handbell as set forth in claim 1 in which said companion magnetic means comprises a first pair of permanent magnets located inside the bell at substantially diametrically opposite locations substantially in the plane of movement of said clapper assembly, and a second pair of permanent magnets carried by said clapper bar for movement toward and away from the first pair of permanent magnets respectively.

3. The handbell as set forth in claim 2 together with a pair of individual mounting means for said second pair of magnets, and each including a threaded stem for adjusting the spacing and hence the repulsion force exerted between the companion pairs of magnets.

4. In a handbell:

(a) a bell;

(b) an operating handle attached to the head of the bell;

(c) a clapper assembly including a clapper and a clapper bar pivotally mounted adjacent the head of the bell for swinging movement in a plane;

(d) a first pair of permanent magnets carried by the clapper bar and movable towards and away from the waist portion of the bell at diametrically opposite sides of the bell;

(e) a cup of non-magnetic material for each of said magnets of said first pair, each cup having a threaded stem for adjustment of the lateral projection of the magnets;

(f) a second pair of permanent magnets; and (g) bracket means mounting said magnets of said second pair in substantial alignment with the arcuate paths of movement of said magnets of said first pair respectively;

(h) said companion magnets imposing a yielding restraint upon movement of said clapper into contact with said bell and to cause retraction of said clapper from said bell after impact.

5. The handbell as set forth in claim 4 in which companion magnets of said first and second pair are free from mechanical contact.

6. A handbell having a bell, a clapper and a clapper bar, the improvement comprising the combination with said bell, clapper and clapper bar of magnetic repulsion means for yieldingly resisting movement of the clapper bar to impact position.

7. The handbell as set forth in claim 6 in which said magnetic repulsion means includes cylindrical magnets having diametrically disposed magnet axes, there being a first pair of cylindrical magnets mounted on opposite sides of said clapper bar, and a second pair of cylindrical magnets mounted inside the bell waist in position to oppose, but not contact the corresponding magnets of the first pair upon swinging movement of the clapper bar.

8. The handbell as set forth in claim 7 together with mounting means for one of said pairs of magnets adjustable to determine the relationship between magnetic repulsion and clapper bar position.

9. The handbell as set forth in claim 7 together with a pair of non-magnetic cups for mounting one of said pairs of magnets, said cups having threaded stems cooperable with threaded sockets for adjustably determining the relationship between magnetic repulsion and clapper bar position.

10. A handbell having an operating handle and a bell having a head:

(a) a clapper bar comprising a pair of spaced apart side plates;

(b) a clapper block mounted for angular movement between first corresponding ends of the side plates and about an axis substantially perpendicular to the side plates;

(c) a bracket attached to the bell adjacent to the head of the bell;

(d) a bearing block located between the second corresponding ends of the bearing plates;

(e) a pin or axle extending through the bearing block and the side plates and pivotally connecting to said bracket for swinging movement of the clapper bar about an axis parallel to said clapper block axis;

(f) a first pair of permanent magnets positioned between the bearing plates between the bearing block and the clapper block, and respectively addressed in the swing directions of the clapper bar; and (g) a second pair of permanent magnets carried by the bracket and positioned to be opposed to the respective magnets of the first pair;

(h) said magnets exerting forces of repulsion as the clapper approaches and arrives at impact position without mechanical engagement of the magnets.

11. The handbell as set forth in claim 10 together with a plurality of pairs of bumpers carried on said clapper block selective positioned for operation upon angular movement of said clapper block.

* * * * *